US005537966A

United States Patent [19]

Ohnishi

[11] Patent Number: 5,537,966

[45] Date of Patent: Jul. 23, 1996

[54] POWER STORAGE TYPE RECOIL STARTER

[75] Inventor: Hisao Ohnishi, Okayama, Japan

[73] Assignee: Nikkari Co., Ltd., Okayama, Japan

[21] Appl. No.: 237,827

[22] Filed: May 4, 1994

[30] Foreign Application Priority Data

| | | | |
|---|---|---|---|
| May 7, 1993 | [JP] | Japan | 5-131421 |
| Oct. 29, 1993 | [JP] | Japan | 5-294542 |
| Feb. 24, 1994 | [JP] | Japan | 6-052883 |

[51] Int. Cl.[6] ..... F02N 5/02

[52] U.S. Cl. ..... 123/185.14

[58] Field of Search ..... 123/185.14, 185.3, 123/185.4, 185.2

[56] References Cited

U.S. PATENT DOCUMENTS

| | | | |
|---|---|---|---|
| 3,010,443 | 11/1961 | Lyvers | 123/185.14 |
| 3,306,277 | 2/1967 | Gudmundsen | 123/185.14 |
| 3,861,374 | 1/1975 | Dooley et al. | 123/185.14 |

*Primary Examiner*—Andrew M. Dolinar
*Attorney, Agent, or Firm*—Koda and Androlia

[57] ABSTRACT

A power storage type recoil starter used for, for example, an engine of a lawn mower including spiral springs that are wound when a starter rope of a recoil pulley is pulled to rotate the starter wheel of the engine. The spiral spring is coiled up by a repeated pulling action of the starter rope and then suddenly recoiled by releasing a locking mechanism, thus rotating the main shaft of the engine powerfully to start the engine.

4 Claims, 7 Drawing Sheets

POWER STORAGE TYPE RECOIL STARTER

BACKGROUND OF THE INVENTION

1. Field of the Invention

The present invention relates to a power storage type recoil starter for facilitating the start of internal combustion engines.

2. Prior Art

Small internal combustion engines are equipped with a recoil starter, and the starting of the engine is accomplished by pulling a starter rope that is recoiled.

In such recoil starters, a certain amount of experience is necessary to start the engine. The trick is to pull the starter rope strongly at the time the air in the cylinder of the engine is compressed immediately prior to the firing of the plug. However, this operation is not skillfully performed by inexperienced persons and people who have limited strength. These people tend to pull the starter rope with an uneven strength and at a relatively slow speed. The result is that the spark of the plug is small, and ignition does not easily occur. Especially in recent engines equipped with electronic ignition devices, the spark is small, and starting is not easy.

The problem can be solved by an engine equipped with a starter motor. However, this motor is expensive and increases the weight of the engine. Especially for garden equipment which is carried and operated with the engine mounted thereon, such a weight increase is not welcome. In addition, there are also problems in terms of power consumption.

SUMMARY OF THE INVENTION

Accordingly, it is a primary object of the present invention to solve the problems described above. More specifically, in the present invention, power is stored in a recoil starter via flat spiral springs, and at the time of starting, the stored power is released all at once so that the starter is rotated at a high speed to start the engine.

In order to accomplish the object, the recoil starter of the present invention uses a unique structure wherein a starter wheel which is attached to the main shaft of an engine and a recoil pulley which rotates the starter wheel in a starting direction are installed separately, and between these two elements is provided: a first drum which is rotated by the recoil pulley in the direction opposite from the starting direction, a second drum which is coupled to the first drum so as to be rotated, a speed reduction mechanism which is installed between the recoil pulley and the first drum, a clutch mechanism which makes and releases a coupling between the first and second drums, flat spiral springs which are installed between the second drum and spring holders so as to be wound out of the spring holders by the rotation of the second drum in a direction opposite to the starting direction so that the rewinding force of the spring is stored in the second drum as a rotational force in the starting direction, a locking mechanism which restrains the rotation of the second drum in the starting direction, and a release mechanism which releases the locking mechanism and disengages the clutch mechanism simultaneously.

The object of the present invention is accomplished by another unique structure for a recoil starter structure wherein a starter wheel which is attached to the main shaft of an engine and a recoil pulley which rotates the starter wheel in the starting direction are installed separately, and between these two elements are provided: a first drum which is rotated by the recoil pulley in the opposite direction from the starting direction, a rotatable second drum, a speed reduction mechanism which is installed between the recoil pulley and the first drum, a one-way clutch mechanism which allows the rotation of the first drum in the starting direction and restrains the rotation of the first drum in the direction opposite to the starting direction, a flat spiral spring which is installed between the first and second drums so as to be wound by the rotation of the first drum in the starting direction so that the rewinding force of the spring is stored in the second drum as a rotational force in the starting direction, a locking mechanism which restrains the rotation of the second drum in the starting direction, and a release mechanism which releases the locking mechanism.

The object of the present invention is accomplished by still another structure for a recoil starter wherein a starter wheel which is attached to the main shaft of an engine and a recoil pulley which rotates the starter wheel in the starting direction are installed separately, and between these two elements are provided with: a first drum which is rotated by the recoil pulley in the opposite direction from the starting direction, a rotatable second drum, a speed reduction mechanism which is installed between the recoil pulley and the first drum, a one-way clutch mechanism which allows the rotation of the first drum in the starting direction and restrains the rotation of the first drum in the direction opposite to the starting direction, and a flat spiral spring which is installed between the first and second drums so as to be wound by the rotation of the first drum in the starting direction so that the rewinding force of the spring is stored in the second drum as a rotational force in the starting direction.

With any one of the above structures of the present invention, even if the recoil pulley is driven at a slow speed and in a small amount via a starter rope, repetition of this driving for several times can cause a starting force to be stored by the flat spiral spring. Accordingly, an increased high-speed rotational force can be applied to the starter wheel by the spiral spring, so that the engine can be started without any failure, and energy saving is also accomplished.

DETAILED DESCRIPTION OF THE INVENTION

Figure 1:
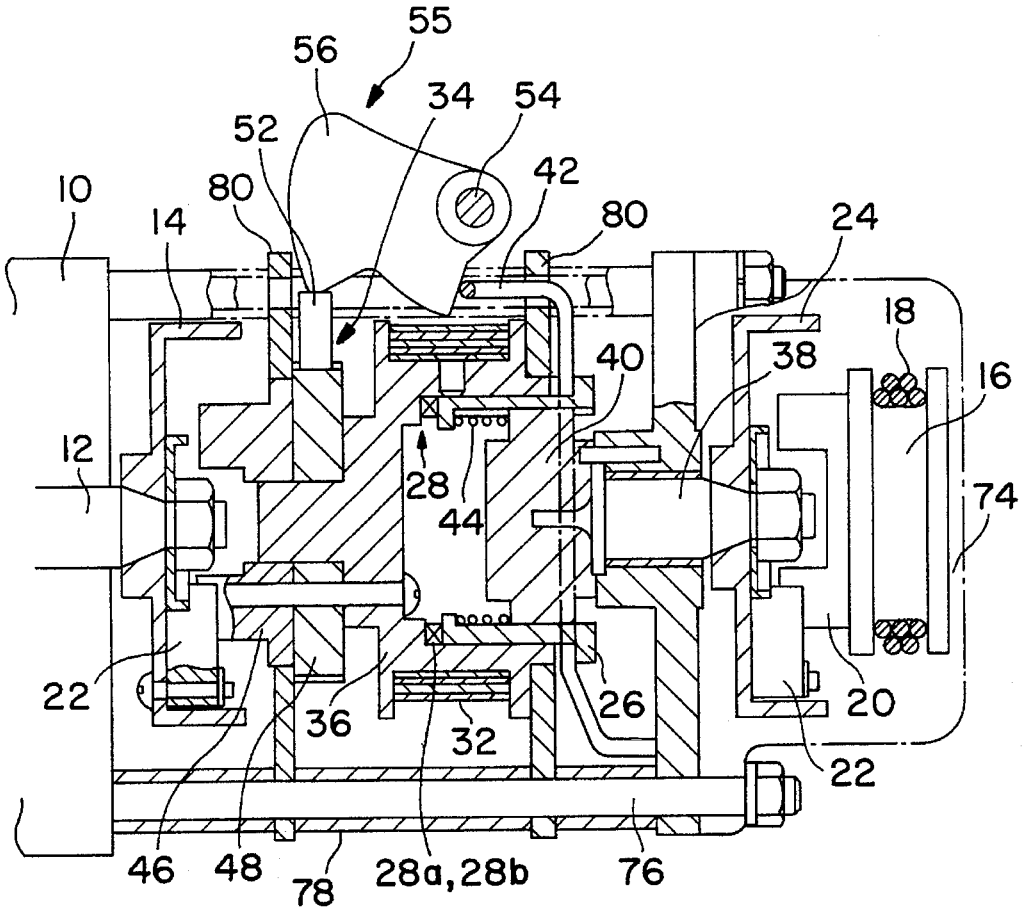
FIG. 1 is a longitudinal cross sectional view of the power storage type recoil starter of the present application.

As seen from FIG. 1, in the power storage type recoil starter of the present invention, a starter wheel 14 which is attached to the main shaft 12 of an engine 10 and a recoil pulley 16 which rotationally drives the starter wheel 14 are separately installed from each other; and the recoil starter is provided between these two elements.

Figure 3:
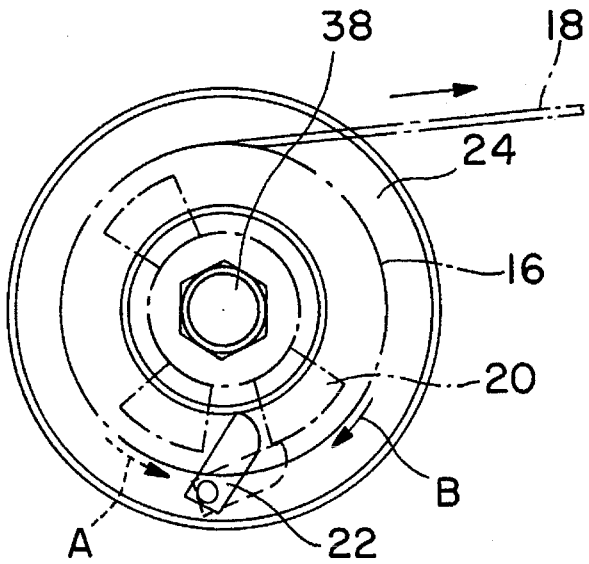
FIG. 3 is a right-side view of the starter wheel of the recoil starter of FIG. 1.

FIG. 3 shows the right-side of the recoil pulley 16. The recoil pulley 16 is a rotatable member having therein a known recoil mechanism, and a starter rope 18 is wound around the outside circumference of the pulley 16. A rotating block 20 is provided so as to project from the inside surface of the pulley 16 as seen in FIG. 1.

A driving wheel 24 is installed next to the recoil pulley 16. The driving wheel 24 is the same in structure as the starter wheel 14 and is rotated via a dog 22 when the recoil pulley 16 is rotated in one direction. More specifically, the recoil pulley 16 is rotated alone in the counterclockwise or recoil direction that is shown by arrow A in FIG. 3 but when the pulley 16 is rotated via the starter rope 18 clockwise as shown by arrow B, the pulley 16 engages with the driving wheel 24 and rotates the driving wheel 24.

A first drum 26 and a second drum 36 are installed between the recoil pulley 16 and the starter wheel 14.

The first drum 26 is rotated by the recoil pulley 16 in the opposite direction (called the "anti-starting direction") which is opposite from the starting direction of the starter wheel 14 (called the "starting direction"). The second drum 36 is rotated by the first drum 26 via a clutch mechanism 28 which is installed between the first drum 26 and the second drum 36.

Figure 4:
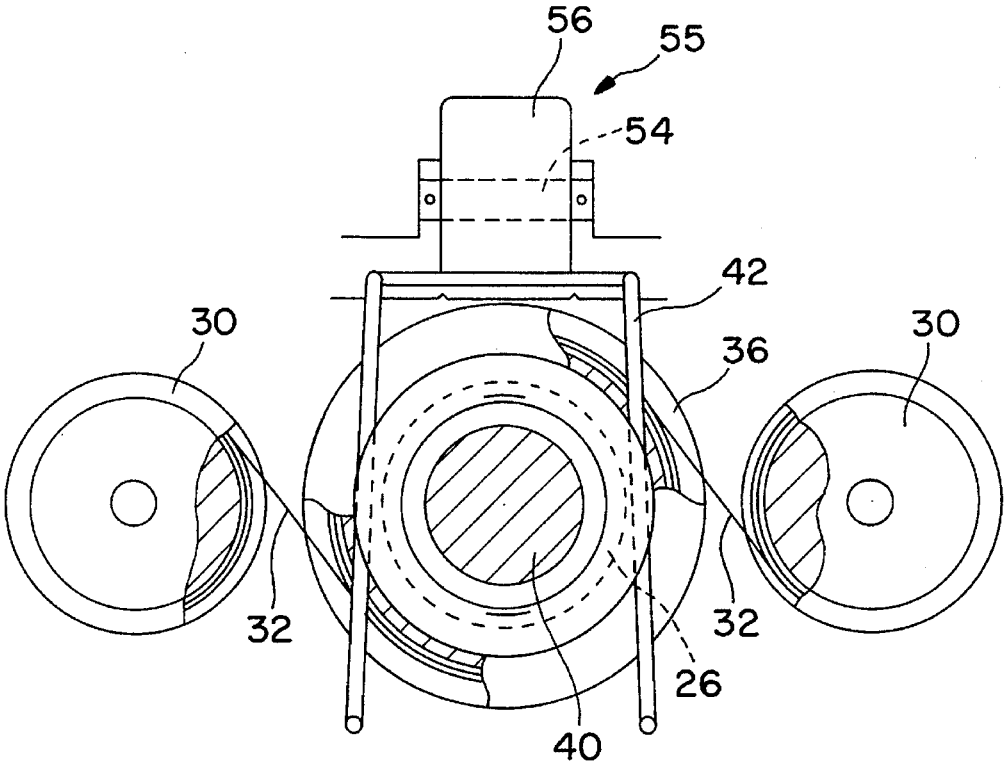
FIG. 4 is a right-side cross sectional view of the second drum and two spring holders along with flat spiral springs used in the starter of FIG. 1.

When the second drum 36 is rotated, it winds out flat spiral springs 32 installed between the second drum 36 and spring holders 30 as seen in FIG. 4 so that the rewinding force of the springs 32 is stored as a rotational force in the starting direction when the rotation of the second drum 36 in the starting direction (shown by arrow B in FIG. 3) is restrained by a locking mechanism 34.

More specifically, a drive shaft 38 of the driving wheel 24 is inserted as an input shaft into a planetary type speed reduction mechanism 40. The outer circumference of this speed reduction mechanism 40 is formed as a rotation outputting member. The direction of rotation of this outputting member is opposite to the rotational direction of an rotation inputting member of the reduction mechanism 40 which is connected to the drive shaft 38.

The first drum 26 is fitted over the thus designed outputting member of the speed reduction mechanism 40 so as to be free to slide in an axial direction. As a result, the rotational force of the recoil pulley 16 is transmitted to the first drum 26 with the speed reduced by approximately ⅕ by the speed reduction mechanism 40 and with the direction of rotation of the drive shaft 38 reversed. The second drum 36 is fitted loosely over the outer circumference of the first drum 26, and a clutch mechanism 28, in which claws **28*a* and 28*b* (see FIG. 2) are engaged with each other, is installed between the facing end surfaces of the two drums. The claws 28*b* is provided on the end surface of the first drum 26, and the claws 28*a* is provided on the end surface of the second drum 36**.

The clutch mechanism 28 functions upon the sliding motion of the first drum 26. In particular, when the first drum 26 slides in the direction which causes it to move out of the second drum 36 (in other words to the right in FIG. 1), the engaging claws **28*a* and 28*b* are separated; and when the first drum 26 slides in the direction which causes it to move into the second drum 36 (in other words to the left in FIG. 1), the claws 28*a* and 28*b*** are engaged.

Figure 2:
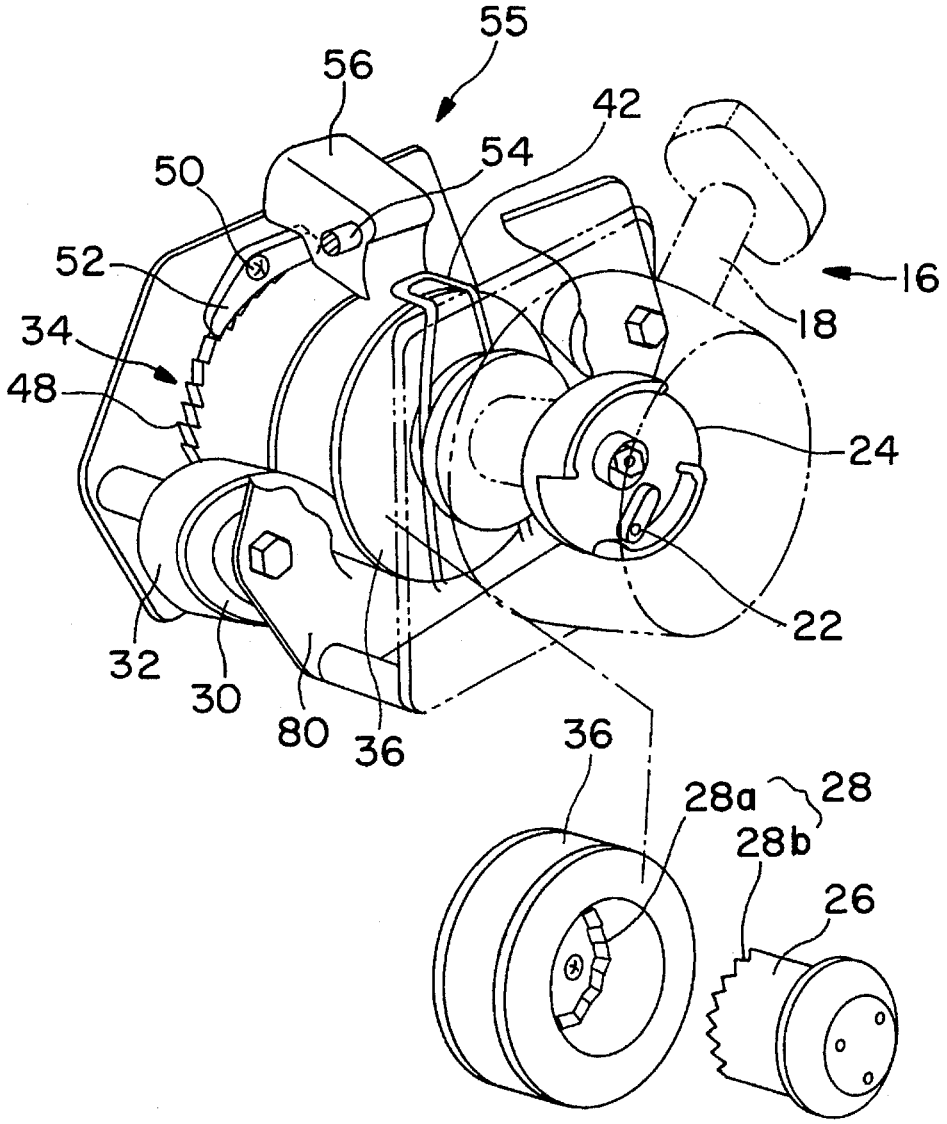
FIG. 2 is a perspective view thereof.

The above described sliding motion of the first drum 26 is accomplished by moving or pushing a wire spring 42 that is provided in an erected posture at the neck of the first drum 26 (FIG. 2). The wire spring 42 is pushed by a release mechanism 55 which as will be described below releases a locking mechanism 34. In other words, when the release mechanism 55 is actuated so as to release the locking mechanism 34, the wire spring 42 is moved or pushed to the right in FIG. 1, separating the engaged claws **28*a* and 28*b*. The first drum 26 is designed so as to be kept urged in the direction (to the left in FIG. 1) which makes it engage with the clutch mechanism 28 by a spring 44 which is installed between the first drum 26 and the speed reduction mechanism 40**.

The spring holders 30, which are respectively in a drum shape and mounted to the frame of the starter, are provided on both sides of the second drum 36 so that the axes of the holders 30 and the second drum 36 are parallel. To the outer circumference of the second drum 36, one end of each one of the flat spiral springs 32 held in the spring holders is secured. Another end of each spring 32 is secured to each one of the drum shaped spring holders 30. FIG. 4 shows the installation of the flat spiral springs 32.

The spiral springs 32 are a shape-memory type spring; and when the springs 32 are wound out of the spring holders 30 and wound on the second drum 36, a rewinding force that corresponds to the amount of deformation of the springs 32 is generated, so that this force is stored in the second drum 36 as a rotational force in the starting direction.

In the structure shown in FIG. 4, two spring holders 30 are used so that they are provided on both sides of the second drum 36. However, only one spring holder 30 can be used along with only one spring 32 as long as an appropriate rewinding force can be generated by one spring.

Figure 5:
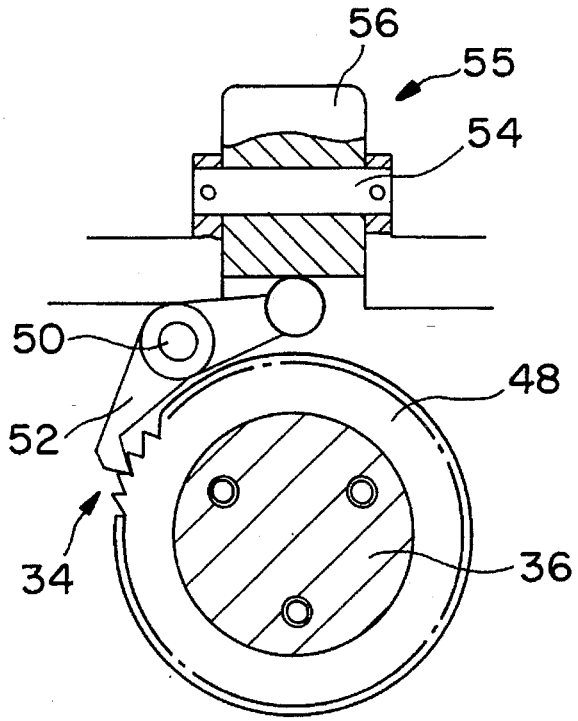
FIG. 5 is a right-side cross sectional view of the ratchet used in the starter of FIG. 1.

A locking mechanism 34 which restrains the rotation of the second drum 36 in the starting direction is installed on the second drum 36. FIG. 5 shows the locking mechanism 34. As seen from FIG. 5 and also from FIG. 1, a ratchet wheel 48 is provided on the second drum 36, and a rotating block 46 which acts in the same way as the rotating block 20 of the recoil pulley 16 does is mounted on this ratchet wheel 48. A locking arm 52 is installed so as to pivot about a pin 50. The locking arm 52 engages with the ratchet wheel 48 so that rotation of the ratchet wheel 48 in the starting direction is restrained.

Near the locking arm 52, a release mechanism 55 is provided. The release mechanism 50 for releasing the locking mechanism 34 includes a lever 56 which pivots about a pin 54. When this lever 56 is pushed down, it acts on the locking arm 52, and the locking arm 52 is disengaged from the ratchet wheel 48. As seen from FIG. 1, the lever 56 is shaped so as to be in touch not only with the locking 52 but also with the wire spring 42. Thus, when the lever 56 is pushed down, the wire spring 42 is pushed to the right in FIG. 1, causing the first drum 26 to be slide to the right to disengage the clutch mechanism 28.

As seen from the above, the operation of release mechanism 55 affects both locking mechanism 34 and clutch mechanism 28.

In operation, the starter rope 18 is pulled so that the recoil pulley 16 is rotated clockwise or in the starting direction. The starter rope 18 is coiled back on the recoil pulley 16 by the recoil mechanism of the recoil pulley. As a result, the driving wheel 24 is rotated clockwise, and this rotational force is transmitted to the first drum 26 with the speed reduced and the rotational direction reversed to counterclockwise by the planetary type speed reduction mechanism 40. The clutch mechanism 28, as a result, causes the second drum 36 to rotate by the same amount and in the same direction, causing the flat spiral springs 32 to be wound out of the spring holders 30 and wound around the second drum 36.

When a prescribed amount of each of the flat spiral springs 32 is wound around the second drum 36 and power is stored, the second drum 36 is urged to rotate in the clockwise direction by the rewinding force of the springs 32. However, this rotation is restrained by the locking mechanism 34.

When the second drum 36 is rotated by a prescribed amount and the rewinding force of the flat spiral springs 32 has become sufficiently strong, the release mechanism 55 is actuated so that the locking mechanism 34 is released and the clutch mechanism 28 is disengaged. As a result, the rewinding force of the flat spiral springs 32 causes the second drum 36 alone to rotate clockwise. The rotating block 46 installed on the second drum 36 acts on a dog 22 provided on the starter wheel 14, thus causing the main shaft 12 to rotate via the starter wheel 14 in the starting direction so that the engine 10 is started.

Figure 6:
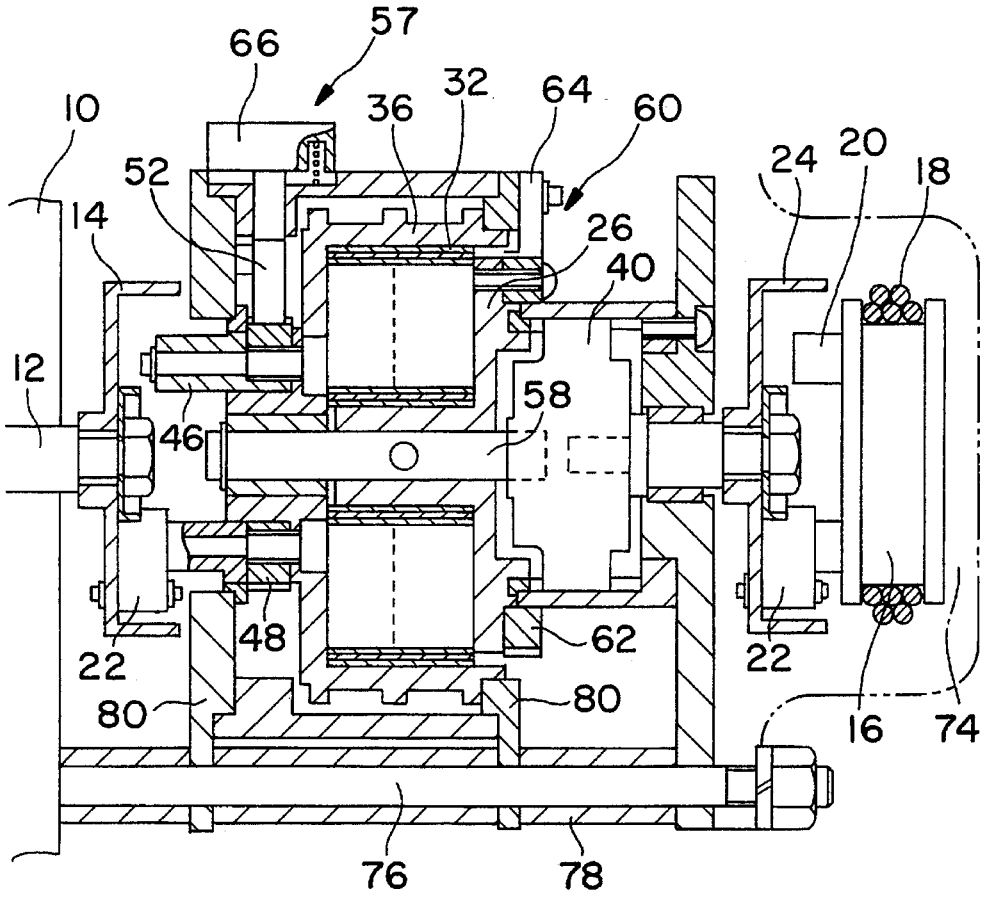
FIG. 6 is a longitudinal cross sectional view of another type of the power storage type recoil starter of the present invention.

FIG. 6 shows another type of power storage type recoil starter of the present invention. In this structure, the first and second drums 26 and 36 are provided so as to overlap one inside the other, and a flat spiral spring 32 is installed between these two drums 26 and 36 so that the second drum 36 is rotated by the rewinding force of the spring 32.

More specifically, the output shaft 58 of the speed reduction mechanism 40 is long enough so that the first drum 26 and the second drum 36 are fitted on this output shaft 58. The first drum 26 has a small diameter portion so as to be fitted on the output shaft 58 and is located inside the second drum 36. The flat spiral spring 32 is installed between the thus arranged first drum 26 and second drum 36 which has a larger diameter than the first drum 26.

In this structure, in order to store the rotational power of the flat spiral spring 32 via the recoil pulley 16 so that a clockwise rotational force is imparted to the second drum 36, it is necessary to rotate the first drum 26 clockwise and to prevent the first drum 26 from being rotated counterclockwise when the recoil pulley 16 is coiled back. In order to satisfy this, a one-way clutch mechanism 60 is used so that it prevents the counterclockwise rotation of the first drum 26.

Figure 7:
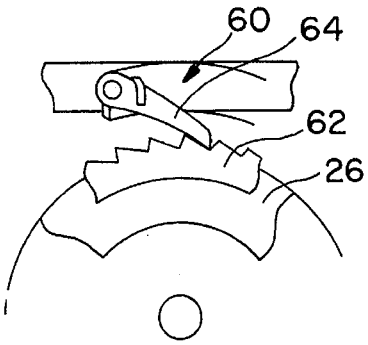
FIG. 7 is a right-side view of the one-way clutch used in the starter of FIG. 6.

FIG. 7 shows a part of the right-side of the one-way clutch mechanism 60. The clutch mechanism 60 is a ratchet type and includes a ratchet wheel 62 provided on the first drum 26 and a locking lever 64 which is pivotally attached to the frame of the starter.

Figure 8:
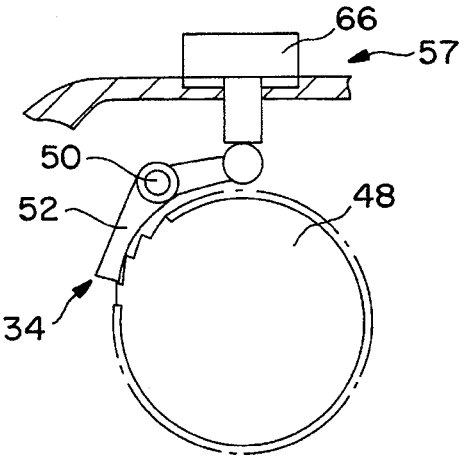
FIG. 8 is a right-side cross sectional view of the ratchet used in the starter of FIG. 6.

FIG. 8 shows the right-side of the locking mechanism 34 that prevents the rotation of the second drum 36 in the clockwise direction. In this structure, the release mechanism 57 which releases the locking arm 52 for preventing the rotation of the second drum 36 in the clockwise direction is provided with a knob 66.

Thus, when the recoil pulley 16 is rotated several times clockwise which is the same as the starting direction so that a rewinding force is stored in the flat spiral spring 32, the release mechanism 57 is operated. This operation causes the second drum 36 to rotate clockwise by the force of the spring 32. As a result, the starter wheel 14 is rotated by the rotating block 46 installed on the second drum 36, rotating the main shaft 12 of the engine 10.

The feature of this structure is that the first drum 26 and second drum 36 are rotated in the same direction when power is stored in the flat spiral spring 32. Thus, the one-way clutch mechanism 60, which does not require a disengaging operation as the clutch mechanism 28 in the structure of FIG. 1 does, is sufficient. In addition, since the flat spiral spring 32 is wound concentrically between the first drum 26 and the second drum 36, the overall size of the starter can be smaller.

In the above structure, however, the flat spiral springs 32 might cause problems. In particular, the rotational force that occurs when the locking mechanism 34 is released might cause a large shock to the area where the spring 32 and first drum 26 are installed. As a result, breakage may occur at this area.

Figure 9:
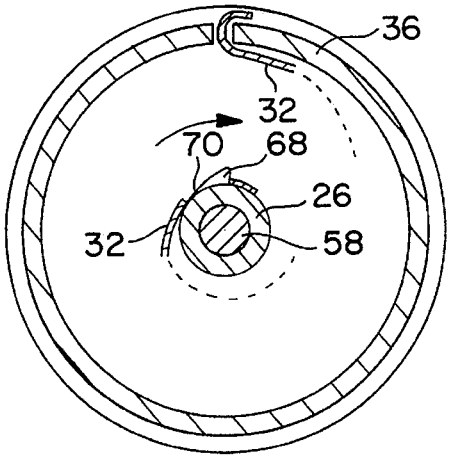
FIG. 9 is a right-side cross sectional view of the second drum and first drum along with a flat spiral spring used in the starter of FIG. 6.

FIG. 9 shows the right-side of a means that can prevent this breakage. The preventative means includes an anchoring projection 68 formed on the outer circumference of the first drum 26 and an anchoring hole 70 formed at the inside end of the flat spiral spring 32, so that the flat spiral spring 32 is secured to the first drum 26 by bringing the anchoring projection into the anchoring hole 70. The anchoring projection 68 is a peak-shape. It engages with the anchoring hole 70 when the first drum 26 rotates in the direction that tightens the flat spiral spring 32 and disengages from the anchoring hole 70 when the first drum 26 rotates in the direction that relaxes the spiral spring 32.

In particular, the slope of the front surface (right-side surface in FIG. 9) of the projection 68 is abrupt, while the slope of the back surface (left-side surface in FIG. 9) is gradual. As a result, the second drum 36 can rotate abruptly clockwise in FIG. 9, and when this rotational force reaches the inside end of the spiral spring 32, the resulting inertia causes the anchoring hole 70 to disengage from the anchoring projection 68, thus preventing the breakage. When the first drum 26 is rotated clockwise in FIG. 9, the anchoring projection 68 enters the anchoring hole 70, so that the spiral spring 32 is wound over the first drum 26.

Breakage may occur to the rotating block 46 which drives the starter wheel 14 of the engine 10. In particular, when the rotating block 46 is driven by the rewinding force of the flat spiral spring 32, the starter wheel 14 may be broken by the resulting shock if the rotating block 46 and the dog 22 of the starter wheel 14 are too far apart. In severe cases, the crankshaft of the engine 10 may bend.

Figure 10:
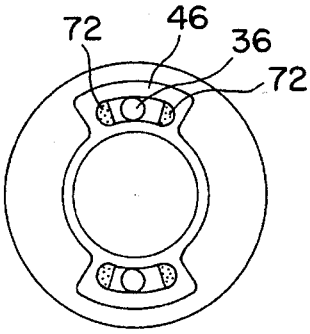
FIG. 10 is a left-side cross sectional view of the rotating block of the second drum used in the starter of FIG. 6.

FIG. 10 shows the left-side of the rotating block 46 provided with a breakage preventive means. The rotating block 46 is provided so that it is capable of making a certain degree of relative rotation with respect to the second drum 36, and a shock-absorbing material 72 such as rubber, etc. is attached to the contact areas (or load contact areas) of the rotating block 46 and the second drum 36, thus alleviating shocks. The shock-absorbing material 72 may be installed on both the load side and the opposite side as shown in FIG. 10.

Figure 11:
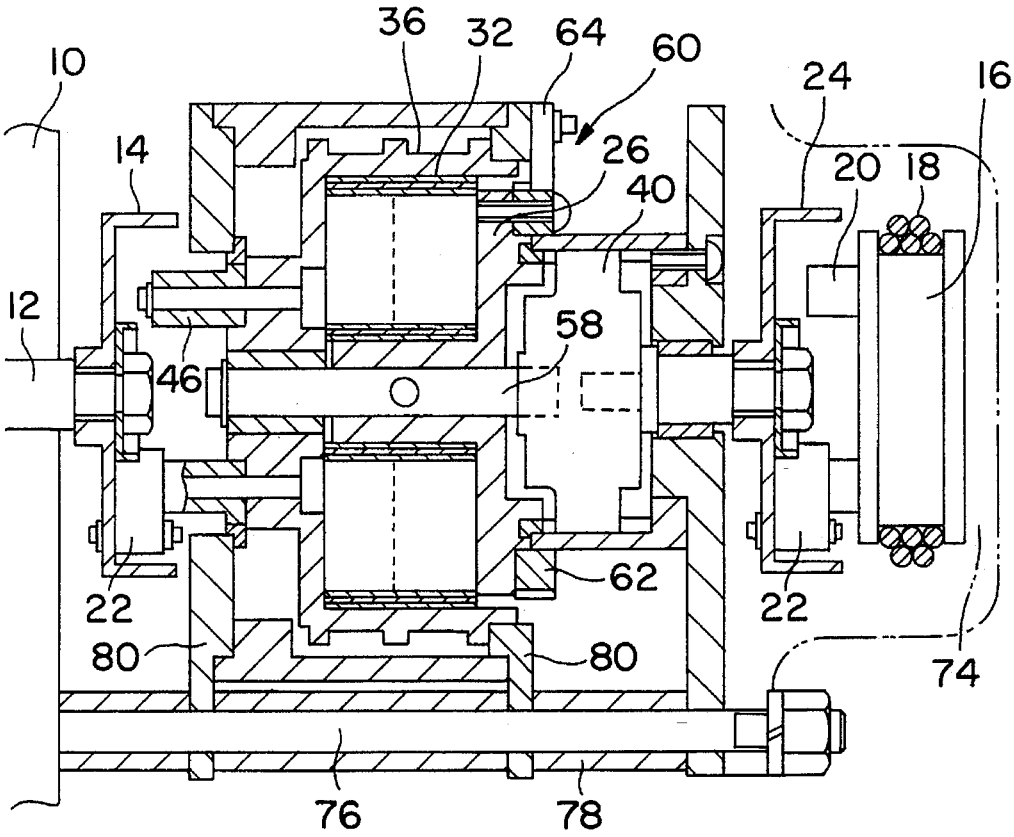
FIG. 11 is a longitudinal cross sectional view of the still another type of power storage type recoil starter of the present invention.

FIG. 11 shows still another type of power storage type recoil starter of the present invention. This starter is the same as the starter shown in FIG. 6 except that the locking mechanism 34 and release mechanism 57 are not used. In this structure, the clockwise rotational force of the second drum 36 caused by the power of the flat spiral spring 32 is not restricted but is constantly applied to the starter wheel 14 as a load.

Before the engine enters the compression stroke, a considerable resistance is generated and applied onto the starter wheel 14 via the main shaft 12. Accordingly, if the stored force of the flat spiral spring 32 overcomes this resistance, the starter wheel 14 can be rotated in the starting direction.

In this structure as well, the starter wheel 14 begins to rotate only after the recoil pulley 16 has been driven several times. Accordingly, the force for rotating the starter wheel 14 is greatly larger than the force obtained by directly rotating the recoil pulley 16 via the starter rope 18. Thus, reliable starting can be secured.

The structure in FIG. 11 is simple. In addition, since the starting is performed with the rotating block 46 of the second drum 36 being in contact with the dog 20 of the starter wheel 14, almost no shock will occur.

In the embodiments described above, the recoil pulley 16 and driving wheel 24 are installed in a casing 74 and-mounted to the engine 10 via bolts 76 at a fixed distance from the starter wheel 14 using spacers 78. The rotatable members in the embodiments such as the first drum 26, the second drum 36, etc. are also provided in a rotatable manner by supporting plates 80 and other supporting members which are installed at prescribed positions by the bolts 76 and spacers 78.

As seen from the above, according to the present invention, power is stored as a strong force via the flat spiral springs even if the starting operation is slow and done weakly. Furthermore, the starter wheel and the recoil pulley which are installed with a space in between can be used without any modification in structure. It is only necessary to install the recoil starter in such a space. Accordingly, assembly is easy, and existing recoil starters can easily be modified.

I claim:

1. A power storage type recoil starter comprising a starter wheel attached to a main shaft of an engine and a recoil pulley spacedly provided from said starter wheel so as to rotate said starter wheel in a starting direction, and further comprising, between said starter wheel and said recoil pulley:

a first drum which is rotated by said recoil pulley in a direction opposite from said starting direction;

a second drum which is coupled to said first drum so as to be rotated;

a speed reduction mechanism which is installed between said recoil pulley and said first drum;

a one way clutch mechanism which allows a rotation of said first drum in said starting direction and restrains a rotation of said first drum in a direction opposite to said starting direction when said recoil pulley is coiled back;

a spiral spring which is installed between said first drum and said second drum, said spiral spring being wound by a rotation of said first drum in a direction of said starting direction so that a rewinding force of said spiral spring is stored in said second drum as rotational force in said starting direction;

a locking mechanism which restrains a rotation of said second drum in said starting direction;

a release mechanism which releases said locking mechanism and disengages said clutch mechanism simultaneously, a rotating block provided on said second drum for rotating said starter wheel said rotating block being provided such that said rotating block makes relative rotation for prescribed angle with respect to said second drum; and shock absorbing members interposed in contact areas between said second drum and said rotating block.

2. A power storage type recoil starter comprising a starter wheel which is attached to a main shaft of an engine and a recoil pulley which is spacedly provided from said starter wheel so as to rotate said starter wheel in a starting direction, and further comprising, between said starter wheel and said recoil pulley:

a first drum which is rotated by said recoil pulley in a direction opposite from said starting direction;

a second drum which is coupled to said first drum so as to be rotated;

a speed reduction mechanism which is installed between said recoil pulley and said first drum;

a one-way clutch mechanism which allows a rotation of said first drum in said starting direction and restrains a rotation of said first drum in a direction opposite to said starting direction when said recoil pulley is coiled back;

a flat spiral spring which is installed between said first drum and said second drum, said flat spiral spring being wound by a rotation of said first drum in a direction of said starting direction so that a rewinding force of said spring is stored in said second drum as a rotational force in said starting direction;

a locking mechanism which restrains a rotation of said second drum in said starting direction; and a release mechanism which releases said locking mechanism and disengages said clutch mechanism simultaneously.

3. A power storage type recoil starter comprising a starter wheel which is attached to a main shaft of an engine and a recoil pulley which is spacedly provided from said starter wheel so as to rotate said starter wheel in a starting direction, and further comprising, between said starter wheel and said recoil pulley:

a first drum which is rotated by said recoil pulley in a direction opposite from said starting direction;

a second drum which is coupled to said first drum so as to be rotated;

a speed reduction mechanism which is installed between said recoil pulley and said first drum;

a one-way clutch mechanism which allows a rotation of said first drum in said starting direction and restrains a rotation of said first drum in a direction opposite to said starting direction when said recoil pulley is coiled back; and a flat spiral spring which is installed between said first drum and said second drum, said flat spiral spring being wound by a rotation of said first drum in a direction of said starting direction so that a rewinding force of said spring is stored in said second drum as a rotational force in said starting direction.

4. A power storage type recoil starter according to claim 2 or 3, wherein said first drum is provided with an anchoring projection on an outside circumference of said first drum, and said flat spiral spring is provided with an anchoring hole at one end of said spiral spring so that said spiral spring is connected to said first drum via said anchoring projection engaged with said anchoring hole, said anchoring projection being formed in a peak-shape so that said peak-shape anchoring projection engages with said anchoring hole when said first drum is rotated in a direction that tightens said flat spiral spring and so that said peak-shaped anchoring projection is disengaged from said anchoring hole when said first drum is rotated in a direction that relaxes said flat spiral spring.

* * * * *